US006466750B2

(12) United States Patent
McIntyre

(10) Patent No.: US 6,466,750 B2
(45) Date of Patent: Oct. 15, 2002

(54) METHOD AND SYSTEM OF FUSING PORTIONS OF A PRINT MEDIUM

(75) Inventor: C. Kevin McIntyre, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/728,744

(22) Filed: Dec. 1, 2000

(65) Prior Publication Data

US 2002/0067935 A1 Jun. 6, 2002

(51) Int. Cl.[7] ..... G03G 15/20

(52) U.S. Cl. ..... 399/67; 219/216; 399/328; 399/334

(58) Field of Search ..... 399/67, 69, 320, 399/328, 330, 334, 336, 337; 432/60; 219/216, 469

(56) References Cited

U.S. PATENT DOCUMENTS

| | | | | |
|---|---|---|---|---|
| 4,434,353 A | * | 2/1984 | Marsh et al. | 219/216 |
| 5,151,719 A | * | 9/1992 | Akutsu et al. | 399/328 X |
| 5,402,211 A | * | 3/1995 | Yoshikawa | 219/216 X |
| 5,402,220 A | * | 3/1995 | Tanaka et al. | 219/216 X |
| 5,436,710 A | * | 7/1995 | Uchiyama | 219/216 X |

* cited by examiner

*Primary Examiner*—William J. Royer

(57) ABSTRACT

A fuser configured to fuse less than all of a printable area of a print medium passing there through, the fuser including an x-fuser and a y-fuser or a first fuser element for fusing one side of a print medium and a second fuser element for fusing another side of the print medium.

18 Claims, 3 Drawing Sheets

(Background)

(Background)

(Background)

METHOD AND SYSTEM OF FUSING PORTIONS OF A PRINT MEDIUM

TECHNICAL FIELD

This invention generally relates to a technology for fusing variable portions of a print medium as it passes through a fuser assembly of an electrophotographic device.

BACKGROUND

FIG. 1 shows a printer 100. More specifically, the printer is a "laser printer," which is a type of printer that utilizes a laser beam to produce an image on a photoconductive drum (which is known as the "photoreceptor"). The light of the laser alters the electrical charge on the drum wherever it hits. The drum is then rolled through a reservoir of toner, which is picked up by the charged portions of the drum. Finally, the toner is transferred to the paper through a combination of heat and pressure. This is also the way copy machines work.

Because an electrophotographic process is used to print, laser printers may be generically called "electrophotographic printers." In addition to the laser printer, there are two other types of printers that fall under the generic category of electrophotographic printers. However, they do not use lasers at all. One category uses an array of LEDs to expose the drum, and the other category uses LCDs. Both of these types of printers may be called "light-array printers." Once the drum is charged, however, all electrophotographic printers (including laser and light-array printers) operate the same.

In conventional electrophotographic printers, a transfer unit cooperating with the photoconductive drum deposits toner onto the print medium, which is then cured or otherwise affixed to the print medium by a heated fuser assembly. An example of a print medium is paper, transparencies, envelopes, and the like.

Photocopier

Conceptually, the print engine in a laser printer is substantially identical to the print engine used in electrophotographic copying machines (i.e., "photocopiers"). The fundamental difference between the two is the source of the image to be printed.

In the case of a copier, an original is illuminated by a high-intensity light and the image from the illuminated original is focused onto the photoreceptor. In the case of a laser printer, control circuitry is used to turn a laser beam on and off as it sweeps a raster pattern over the surface of the photoreceptor to directly create the image to be reproduced. Once the electrostatic image is created on the photoreceptor, the principle of operation of a laser printer and a photocopier are identical.

Unless expressly stated otherwise, references herein to the operation of an electrophotographic printer apply to the operation of an electrophotographic copier. Furthermore, examples of an "electrophotographic device" include an electrophotographic printer (either laser or light-array) and an electrophotographic copier.

The fundamentals of electrophotographic devices are well known to those of ordinary skill in the art.

Fuser Assembly

The purpose of a typical fuser assembly (i.e., "fuser") of a printer is to permanently affix the toner on the paper to the paper. Typically, the fuser heats the paper and the toner thereon as the paper passes through. The heat melts the toner onto the paper. By this process, a so-called hardcopy of an electronic document ("softcopy") is generated.

FIGS. 2A and 2B show two views of a conventional fuser 200. Such a fuser is typically formed from a heated roller 202 having a heated compressible surface 202*a* and a compression roller 204, which is urged against the heated compressible surface. A print medium 206 (such as a piece of paper or any other form of sheet medium) bearing the developed image of toner (not shown) is passed between the heated roller 202 and the compression roller 204. The heated roller 202 is, for example, made of a heat-conductive material, such as an aluminum tube coated with a layer of a heat-durable resin and is fitted with an internal built-in heater.

Alone or in combination with other rollers (not shown), the pair of rollers 202 and 204 may pull the print medium through the fuser 200. Alternatively, other rollers may provide the main locomotion to send the print medium through the fuser. Any device used to move the print medium through the fuser may be called a "medium-transporter."

In FIG. 2A, the print medium 206 travels vertically from bottom to top. In FIG. 2B, the print medium 206 travels horizontally from left to right. The print medium 206 travels from an unfused condition to a fused condition. In FIGS. 2A and 2B, area 206*a* is a portion of the print medium that has yet to pass through the fuser; thus, the toner in area 206*a* is unheated and unaffixed to the print medium. Area 206*b* is a portion of the print medium that has already passed through the fuser; thus, the toner in area 206*b* is heated and affixed to the print medium.

Notice, in FIG. 2A, that the rollers (of which only heated roller 202 is visible) extend across the full width of the print medium 206. The entire breadth of the print medium 206 passes through the fuser 200. The width of a print medium is along the x-axis and the breadth is along the y-axis.

In a conventional fuser (with laterally unmovable rollers such as fuser 200 of FIGS. 2A and 2B), the fuser is "on" (i.e., heated) while the print medium passes there through. Therefore, the medium is fused along its entire width and breadth.

More precisely, a print medium passing through a conventional fuser is fused along the entire width and breadth of the medium's printable area. A small unusable border (e.g., eighth of inch or less) around the perimeter of a print medium is common. In describing the background and this present invention, this unprintable perimeter is ignored.

Notice also that the rollers 202 and 204 do not move laterally relative to the print medium. Lateral movement of the fuser is movement along the x- or y-axes of the medium. Although the print medium 206 passes through the fuser, no part of the fuser moves laterally across the print medium.

The roller configuration shown in FIGS. 2A–2B is one example of a conventional fuser. Another example includes a fuser used for duplex printing. Such a fuser may include two heated rollers (one for each side of a page). Of course, those of ordinary skill in the art understand and appreciate that there are other roller configurations in a conventional fuser.

When fusing a page, a conventional fuser is either on or off. Without the ability to control where and when the fusing occurs, print media such as envelopes with cellophane windows, pages with special inks, adhesive labels, and the like cannot be printed because the heat of the fuser may cause them to melt or degrade. Conventional fusers can only fuse along the entire width and breadth of a page.

SUMMARY

Described herein is a technology for fusing portions of a print medium as it passes through a fuser assembly of an electrophotographic device, such as a laser printer. An implementation, described herein, of the claimed invention includes a fuser of an electrophotographic device that can selectively fuse portions of a print medium passing through the fuser. Rather than fusing the entire width and breadth of a print medium passing through the fuser, an implementation, described herein, of the claimed invention fuses selected portions of the normal printable area of the print medium.

This summary itself is not intended to limit the scope of this patent. For a better understanding of the present invention, please see the following detailed description and appending claims, taken in conjunction with the accompanying drawings. The scope of the present invention is pointed out in the appending claims.

BRIEF DESCRIPTION OF THE DRAWINGS

The same numbers are used throughout the drawings to reference like elements and features.

FIG. 2A is a top plan view of a conventional fuser with a print medium passing there through.

FIG. 2B is an elevation view of the same conventional fuser of FIG. 2A with the same print medium passing there through.

DETAILED DESCRIPTION

The following description sets forth specific embodiments of a method and system of fusing portions of a print medium that incorporate elements recited in the appended claims. These embodiments are described with specificity in order to meet statutory written description, enablement, and best-mode requirements. However, the description itself is not intended to limit the scope of this patent.

Described herein are one or more exemplary implementations of a method and system of fusing portions of a print medium. The inventor intends these exemplary implementations to be examples. The inventor does not intend these exemplary implementations to limit the scope of the claimed present invention. Rather, the inventor has contemplated that the claimed present invention might also be embodied and implemented in other ways, in conjunction with other present or future technologies.

An example of an embodiment of a method and system of fusing portions of a print medium may be referred to as an "exemplary fuser."

Introduction

With an exemplary fuser, a printer may fuse only a portion of a print medium (such as a piece of paper). A user of the printer can specify specific locations on a print medium that should (or should not) be fused during the normal printing process. In addition, a user can choose to fuse only one side of a duplex medium.

Heat (such as that from a fuser) may cause special inks, labels, cellophane windows, and the like to melt, degrade, or other ill effects. Using the exemplary fuser, those areas of a print medium that are heat-sensitive can be avoided during the fusing process.

The exemplary fuser may control the fusing in both x-axis and y-axis directions. The fusing may be controlled along a given axis. For example, when fusing along the x-axis the fuser may be turned on or off as needed. The exemplary fuser may also control which side of a duplexed medium is to be fused.

A user, during design of the print medium to be printed or at print time (via a print driver), may designate particular areas on a print medium to be fusible or non-fusible. The exemplary fuser enables fusing and non-fusing portions of a scan line (along the x-axis) of a print medium. For print media that are being re-fed through the printer, a control panel interface would be provided that would allow fusing on either side of a page only. Alternatively, the user may turn that functionality on/off from the application or printer driver.

Exemplary Fuser

Figure 1:
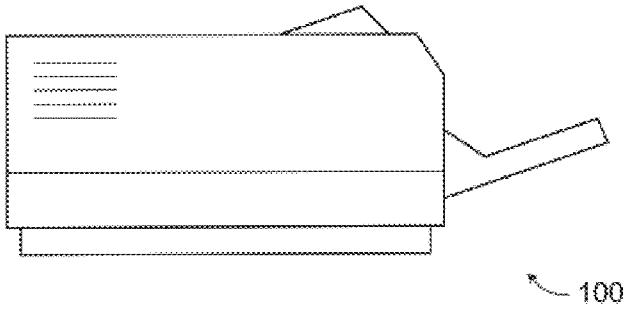
FIG. 1 is an illustration of a conventional laser printer. An embodiment of the invention claimed herein may be implemented as part of such a laser printer.

An electrophotographic device (such as a laser printer in FIG. 1) may include an exemplary fuser implementing the method and system of fusing portions of a print medium.

Figure 3A:
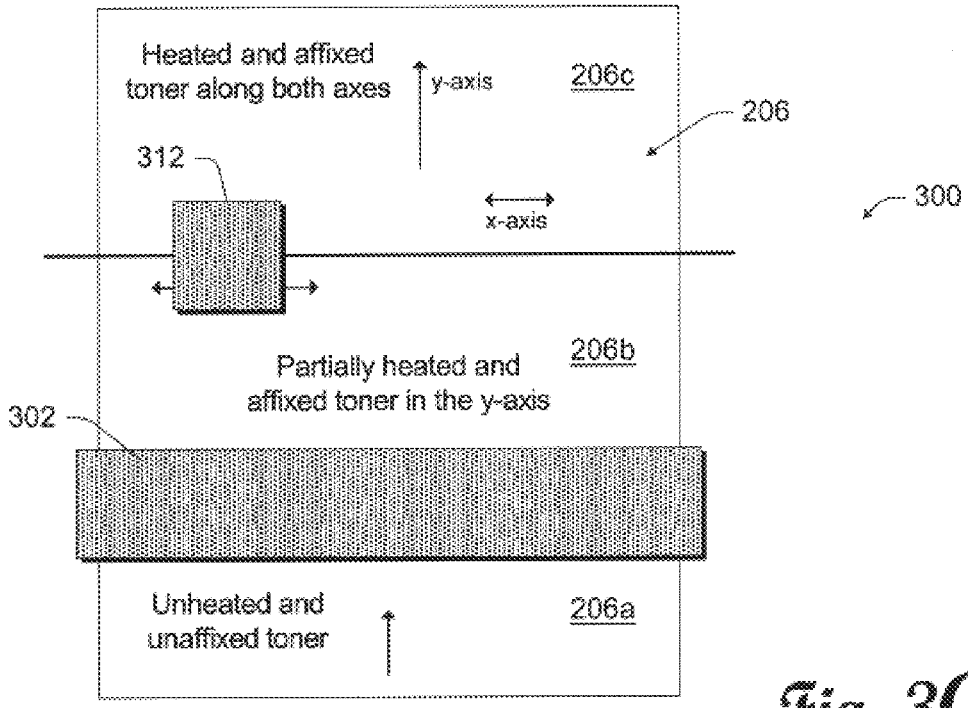
FIG. 3A is a top plan view of an exemplary fuser (with a print medium passing there through) in accordance with an implementation of the invention claimed herein.
Figure 3B:
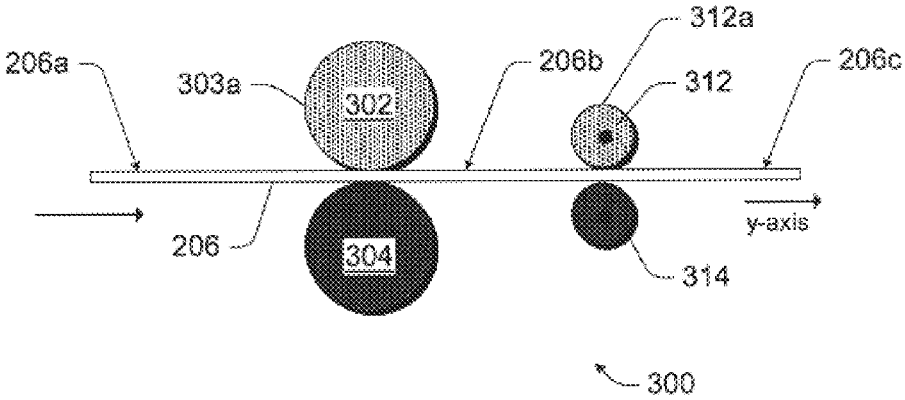
FIG. 3B is an elevation view of the same exemplary fuser of FIG. 3A (with the same print medium passing there through) in accordance with an implementation of the invention claimed herein.

FIGS. 3A and 3B show two views of the exemplary fuser 300. FIG. 3A is a top plan view and FIG. 3B is a elevation view. This exemplary fuser 300 includes a heated roller 302 having a heated compressible surface 303*a* and a compression roller 304, which is urged against the heated compressible surface. A print medium 206 (such as a piece of paper or any other form of sheet medium) bearing the developed image of toner (not shown) is passed between the heated roller 302 and the compression roller 304.

The rollers 302 and 304 do not move laterally relative to the print medium. Lateral movement of the fuser is movement along the x- or y-axes of the medium. Although the print medium 206 passes through the fuser, no part of the rollers 302 and 304 moves laterally across the print medium.

However, this exemplary fuser 300 does include fuser components that move laterally. Specifically, FIGS. 3A and 3B show a laterally mobile heated roller 312 having a heated compressible surface 312*a* paired with a laterally mobile compression roller 314, which is urged against the heated compressible surface 312*a*. A print medium bearing the developed image of toner (not shown) is passed between the heated roller 312 and the compression roller 314. It passes between rollers 312 and 314 after passing through rollers 302 and 304. Alternatively, the print medium may pass through rollers 302 and 304 after passing between rollers 312 and 314.

The heated rollers 302 and 312 are, for example, made of a heat-conductive material, such as an aluminum tube coated with a layer of a heat-durable resin and is fitted with an internal built-in heater.

The width of a print medium is along the x-axis and the breadth is along the y-axis. For the sake of clarity, the rollers 302 and 304 are the "y-rollers" because they fuse the print medium along the y-axis as it passes through them. They may also be called the y-subfuser or the y-fuser. Similarly, the rollers 312 and 314 are the "x-rollers" because they fuse the print medium along the x-axis as it passes through them. They may also be called the x-subfuser or the x-fuser.

In FIG. 3A, the print medium 206 travels vertically from bottom to top. In FIG. 3B, the print medium 206 travels horizontally from left to right. The print medium 206 travels from an unfused condition to a partially fused condition to a more (but not completely) fused condition.

FIG. 3A shows that the rollers 302 and 304 (of which only heated roller 302 is visible) extend across the full width of the print medium 206. The entire breadth of the print medium 206 passes through the fuser 300.

In a conventional fuser, the heated y-roller 302 is "on" (i.e., heated) the entire time while the print medium passes through the y-rollers. Therefore, the medium is fused along is its entire width and breadth. However, in the exemplary fuser the y-fuser is "on" only for selected portions of the print medium. Thus, one or more blocks on the medium are left unfused. These blocks extend across the full width of the medium.

In the exemplary fuser, the x-fuser moves across the medium to fuse selected portions of the medium. To avoid multiple fusing of common areas on the medium, the areas fused by the x-fuser are typically a part of the block left unfused by the y-fuser.

The result of the cooperative actions of the x- and y-fusers is a medium with fused toner thereon, but having a portion of the medium left unfused. This is desirable when there is a given portion of a print medium that would be harmed by the heat of a fuser. For example, a cellophane window of an envelope may melt when heated by a fuser. Not only would this produce poor results, the melted residue may damage the printer's internal components.

In FIGS. 3A and 3B, area 206*a* is an area of the print medium that has yet to pass through the fuser; thus, the toner in area 206*a* is unheated and unaffixed to the print medium. Area 206*b* is an area of the print medium that has already passed through the y-fuser. Since the y-fuser is heated only while selected portions of the print medium pass there through, only the toner in those selected portions of the print medium in area 206*b* are heated and affixed to the print medium. Area 206*c* is an area of the print medium that has already passed through both the y-fuser and the x-fuser. Since the x-fuser is heated only while selected portions of the print medium pass there through, area 206*c* includes heated and affixed toner in selected portions by the x- and y-fusers.

To be precise, conventional fusers leave a small border around the periphery of a print medium unfused. Since fusing is not applicable to the non-printable border, it is not considered herein. Only the normal printable area of a print medium is considered.

The roller configuration shown in FIGS. 3A–3B is one example of an implementation in accordance with the method and system of fusing portions of a print medium. Another example includes a fuser assembly for duplex printing. Such a fuser may include a set of x- and y-heated rollers, one set for each side of a page.

Rollers 302 and 304 of FIG. 3B illustrate an example of a configuration of a set of y-heated rollers of a fuser assembly for duplex printing. Rollers 312 and 314 of FIG. 3B illustrate an example of a configuration of a set of x-heated rollers of a fuser assembly for duplex printing. One or more rollers on the upper-side of a medium (such as rollers 302 and 312 of FIG. 3B) may be referred to as an upper fuser element or fuser set of the duplex fuser assembly. One or more rollers on the lower-side of a medium (such as rollers 304 and 314 of FIG. 3B) may be referred to as a lower fuser element or fuser set of the duplex fuser assembly. The fuser elements may be configured to be selectively activated so that one side or the other of the medium is fused.

Of course, those of ordinary skill in the art understand and appreciate that there are other possible roller configurations within the spirit and scope of the present claimed invention.

Fuser with Pixilated Heating Elements

Figure 2A:
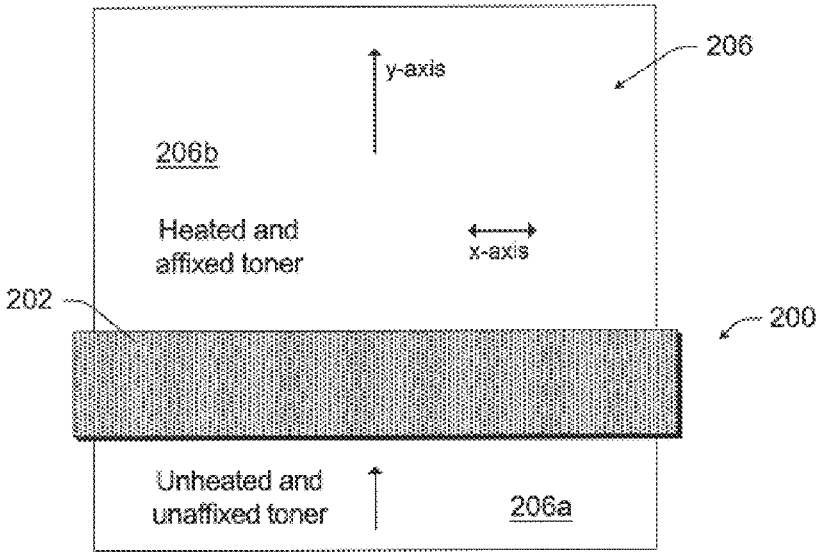
Figure 2B:
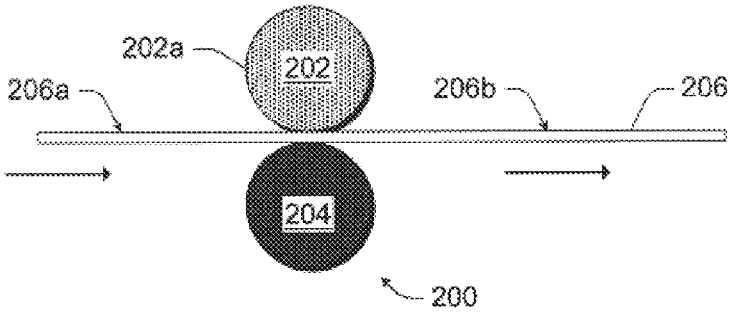

For example, an alternative implementation of method and system of fusing portions of a print medium may be constructed in manner resembling the arrangement of a conventional fuser shown in FIGS. 2A and 2B. Instead of the heated roller have a solid heating element extending across the entire surface of the roller, the surface of the heated roller is composed of an array of heating elements. In a sense, the roller has pixilated heating elements or a raster of heating elements.

Each element is independently addressable so that each may be turned on/off independently of the other elements. Selected heating element "pixels" are turned on/off as they roll across a print media passing through the fuser. Thereby, portions of a print medium may be left unfused.

Methodololical Implementation of the Exemplary Fusing

Figure 4:
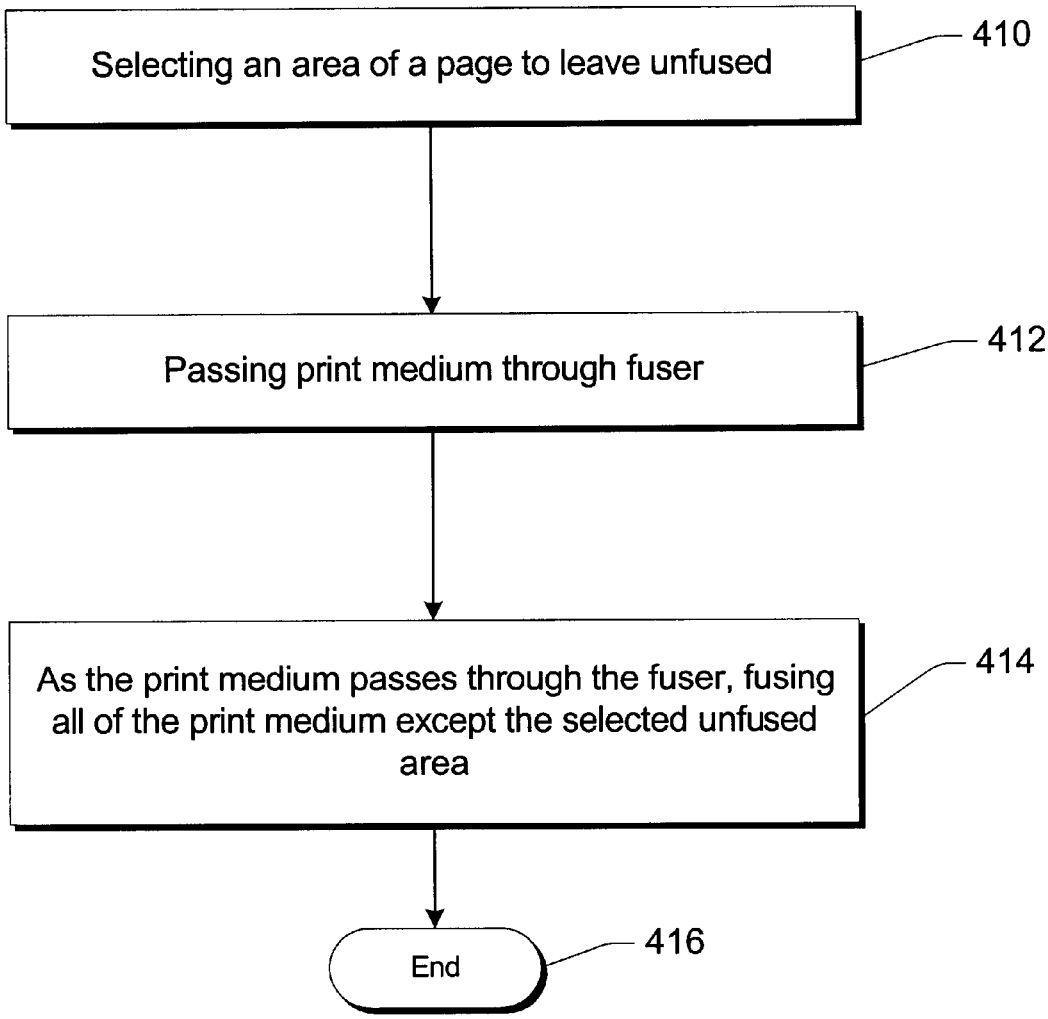
FIG. 4 is a flow diagram of an example of a methodological implementation of the invention claimed herein.

FIG. 4 shows methodological implementation of the exemplary fusing performed by the fuser 300 of FIGS. 3A and 3B (or some portion thereof). This methodological implementation may be performed by a fuser assembly of an electrophotographic device (such as laser printer, light-array printer, and a photocopier).

At 410 of FIG. 4, an area is selected to be left unfused. A user may make this selection via a user interface of a computer or via a control panel on a printer.

At 412, the print medium passes through the exemplary fuser.

At 414, as the print medium passes through the fuser, fusing only a portion of the print medium. Except the selected unfused area, the rest of the page is fused. One way to do this is as follows: a y-fuser fuses portions of the print medium along the y-axis and an x-fuser fuses portions of the print medium along the x-axis. One or both of such fusers may be laterally mobile.

At 416, the process ends.

CONCLUSION

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An electrophotographic device comprising:

a fuser configured to fuse less than all of a printable area of a print medium passing there through, the fuser comprising an x-fuser and a y-fuser;

a medium-transporter configured to move the print medium through the fuser.

2. An electrophotographic device as recited in claim 1, wherein such device is a laser printer.

3. An electrophotographic device as recited in claim 1, the x-fuser being laterally mobile along an x-axis of a print medium.

4. An electrophotographic device as recited in claim 1, the y-fuser being laterally mobile along a y-axis of a print medium.

5. An electrophotographic device as recited in claim 1, wherein the x-fuser comprises at least one roller configured to be heated.

6. An electrophotographic device as recited in claim 1, wherein the y-fuser comprises at least one roller configured to be heated.

7. An electrophotographic device comprising:

a fuser configured to fuse less than all of a printable area of a print medium passing there through, the fuser comprising a first fuser element for fusing one side of the print medium and a second fuser element for fusing another side of the print medium, the fuser elements being configured to be selectively activated so that one side or the other of the print medium is fused;

a medium-transporter configured to move the print medium through the fuser.

8. An electrophotographic device as recited in claim 7, wherein the first fuser element comprises at least one roller configured to be heated.

9. An electrophotographic device as recited in claim 7, wherein the second fuser element comprises at least one roller configured to be heated.

10. A method facilitating fusing less than all of a printable area of a print medium passing through a fuser, the method comprising:

specifying a portion of the printable area of the print medium to be fused, wherein such portion is less than all of the printable area of the print medium;

passing the print medium through the fuser;

fusing the specified portion of the printable area of the print medium with an x-fuser and a y-fuser, wherein the x-fuser or the y-fuser are laterally mobile along its associated axis.

11. A method as recited in claim 10, further comprising providing a user interface for the specifying step.

12. A fuser for fusing less than all of a printable area of a print medium passing there through, the fuser comprising:

a first sub-fuser configured to selectively fuse a portion of the print medium along an axis consistent with a direction that the print medium travels through the fuser;

a second sub-fuser configured to selectively fuse a portion of the print medium along an axis orthogonal to the direction that the print medium travels through the fuser.

13. A fuser as recited claim 12, wherein the first sub-fuser is laterally mobile.

14. A fuser as recited claim 12, wherein the second sub-fuser is laterally mobile.

15. An electrophotographic device comprising a fuser as recited in claim 12.

16. A laser printer comprising a fuser as recited in claim 12.

17. A fuser as recited in claim 12, wherein the first sub-fuser comprises at least one roller configured to be heated.

18. A fuser as recited in claim 12, wherein the second sub-fuser comprises at least one roller configured to be heated.

* * * * *